United States Patent [19]

Grindrod et al.

[11] Patent Number: 4,866,911

[45] Date of Patent: Sep. 19, 1989

[54] METHOD OF FORMING A VACUUM PACKAGE WITH HERMETIC RECLOSURE

[75] Inventors: Paul E. Grindrod, Madison; Ray H. Griesbach, Monona; Darrell G. Cornish, McFarland, all of Wis.

[73] Assignee: Oscar Mayer Foods Corporation, Madison, Wis.

[21] Appl. No.: 126,456

[22] Filed: Nov. 30, 1987

[51] Int. Cl.[4] ..... B65B 31/02

[52] U.S. Cl. ..... 53/432; 53/485

[58] Field of Search ..... 53/432, 433, 434, 485; 206/461, 467, 471; 426/123, 129, 127; 156/152, 292, 327

[56] References Cited

U.S. PATENT DOCUMENTS

| | | | |
|---|---|---|---|
| 3,488,018 | 3/1970 | Seiferth et al. | 53/22 |
| 3,647,485 | 3/1972 | Seiferth et al. | 99/174 |
| 3,650,386 | 3/1972 | Tigner | 426/129 X |
| 3,740,237 | 6/1973 | Grindrod et al. | 99/171 S |
| 3,836,679 | 9/1974 | Seiferth et al. | 426/126 |
| 3,910,410 | 10/1975 | Shaw | 206/471 X |
| 4,215,797 | 8/1980 | Chen | 220/359 |
| 4,411,122 | 10/1983 | Cornish et al. | 53/436 |
| 4,498,588 | 2/1985 | Scott et al. | 206/526 |
| 4,498,589 | 2/1985 | Scott et al. | 206/526 |
| 4,577,757 | 3/1986 | Hustad et al. | 206/461 |

FOREIGN PATENT DOCUMENTS

| | | | |
|---|---|---|---|
| 2029360 | 3/1980 | United Kingdom | 206/461 |

OTHER PUBLICATIONS

*Food and Drug Packaging*, Sep., 1987, p. 18, "Tape Strip Reseals Bags to Keep Tortillas Fresh".

*Primary Examiner*—Robert L. Spruill
*Assistant Examiner*—Beth Bianca
*Attorney, Agent, or Firm*—Joseph T. Harcarik; Thomas R. Savoie; Daniel J. Donovan

[57] ABSTRACT

A continuous method of enclosing a proteinaceous product in a vacuumized and hermetically sealed package having a peelable hermetic reclosure and having a body member of semi-rigid preformed plastic with a first planar marginal portion and a central portion shaped to provide a packaging chamber. The package also has a flexible dimensionally stable base member having a corresponding second planar marginal portion and a central portion to provide a closure for said packaging chamber. The method requires placing a sufficient quantity of proteinaceous product in the central portion of the body member to substantially fill the central portion when the package is completed, positioning the first planar marginal portion face-to-face to the corresponding second planar marginal portion, vacuumizing the assembly, and hermetically sealing the package. The improvement is applying an adhesive to either the first planar marginal portion to provide at least a portion of the hermetic seal wherein said adhesive is a high molecular weight pressure sensitive hot melt adhesive having a viscosity of between 5,000 to 100,000 centipoise at 300° F. and said adhesive provides a peelable hermetic reclosure.

5 Claims, 2 Drawing Sheets

METHOD OF FORMING A VACUUM PACKAGE WITH HERMETIC RECLOSURE

FIELD OF THE INVENTION

This invention pertains to a method of sealing a vacuum packed package for package a proteinaceous product whereby a rigid thermoformed plastic body member is closed and sealed with a flexible plastic film whose surface is coated with a high molecular weight pressure sensitive hot melt adhesive permitting easy peel opening and positive hermetic reclosure.

DESCRIPTION OF THE PRIOR ART

Vacuum packed packages for proteinaceous materials such as sliced luncheon meat are usually sealed by one of the following methods. In one method a heat seal fusion of a material to a similar materials such as polyethelyne to polyethylene, ethylene copolymer to ethylene copolymer or ionomer (Surlyn) to ionomer is used. This produces a fused seal which cannot be peeled open and must be cut or torn to open the package.

Another method produces a peelable heat seal by employing slightly dissimilar materials such as polyethylene to ethylene copolymers, ethylene copolymers to ionomers, polyethylene to polypropylene, low density polyethylene to medium density polyethylene and mixtures of these materials to slightly different mixtures. These seals are not resealable.

Still another method is to employ a soft hot melt adhesive seals of similar and different substrates such as Barex (acrylonitrile-methyl acrylate copolymer polymerized and/or mixed with butadiene as a terpolymer) to Barex, Barex to polyethylene, polyester to polyethylene, Saran to Barex, Saran to PVC, PVC to polyethylene and PVC to PVC. Seals are made by applying hot melt adhesive of relatively low viscosity (800 to 1800 centipoise at 300° F.) to one of the rigid plastic package components in an annular ring ⅛" wide and 10 mils thick at 300° F. and subsequently heat sealing the companion package component at 120° to 200° F. to the adhesive ring.

These holt melt seals permit easy opening by peeling the package components apart. Opening is usually accompanied by a significant occurrence of cohesive adhesive failure where the adhesive itself ruptures with a tendency toward stringing as the adhesive clings to diverging substrates. Cohesive failure and stringing occurs because the internal cohesive strength of the soft, low molecular weight adhesive is less than the adhesive strength at the substrate/adhesive interface. These package components can be resealed, but resealing is complicated by stringing, displaced adhesive and warped, stretched package components. The customer perceives reclosure as potentially non-hermetic.

Descriptions indicating adhesives for providing sealed vacuum packaged products employing both rigid and flexible package parts can be found in U.S. Pat. Nos. 3,498,018 to Seiferth, 3,647,485 to Seiferth et al.; 3,740,237 to Grinrod et. al; 3,836,679 to Seiferth et al.; 4,411,122 to Cornish; 4,498,588 and 4,498,589 to Scott et al; and 4,577,757 to Husted et al. Adhesives have also been used for packages other than vacuum packages. For instance, adhesives are disclosed with a reusable plastic container in U.S. Pat. No. 4,215,797 to Chen.

In the aforementioned methods and patents high molecular weight pressure sensitive hot melt adhesives are not specified and it has been the practice to employ relatively low viscosity hot melts with the aforementioned disadvantages.

It is believed that high molecular weight pressure sensitive hot melt adhesives have been used as a reclosure for food packages. However, these packages are not vacuum packed nor do they contain a rigid component. An example of such a package is described in *Food and Drug Packaging.* September, 1987, page 18, under the article entitled, "Tape Strip Reseals Bags to Keep Tortillas Fresh". According to this disclosure, pressure sensitive tape with adhesives on both sides is used to reseal a food package. The pressure sensitive tape, it is believed, is made of a high molecular weight pressure sensitive hot melt adhesive. However, since a tape is employed rather than putting the adhesive directly onto the package the tape is not suitable for vacuum sealing the package nor is the food product disclosed vacuum sealed.

BRIEF DESCRIPTION OF THE DRAWINGS

The figures are schematic views showing a vacuumized hermetically sealed package with a peelable hermetic reclosure.

SUMMARY OF THE INVENTION

Figure 1:
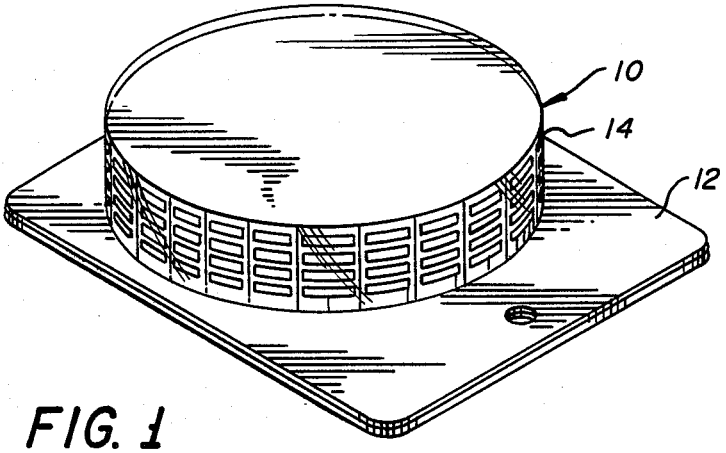
Figure 2:
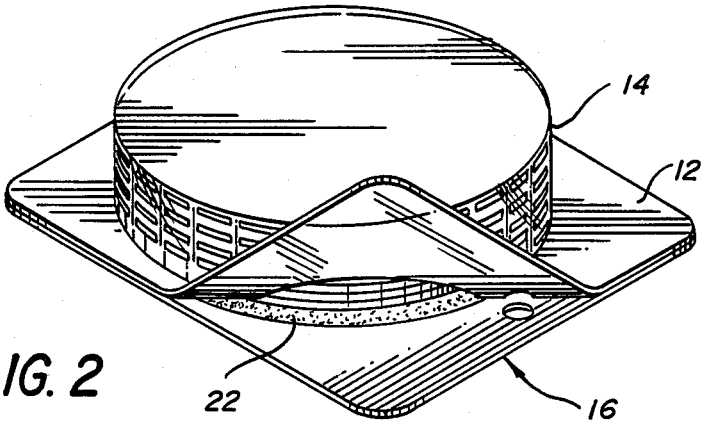
Figure 3:
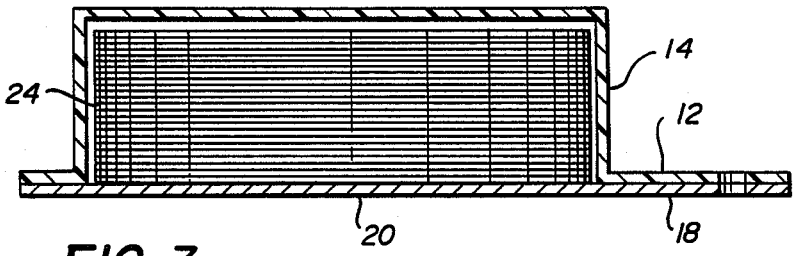
Figure 4:
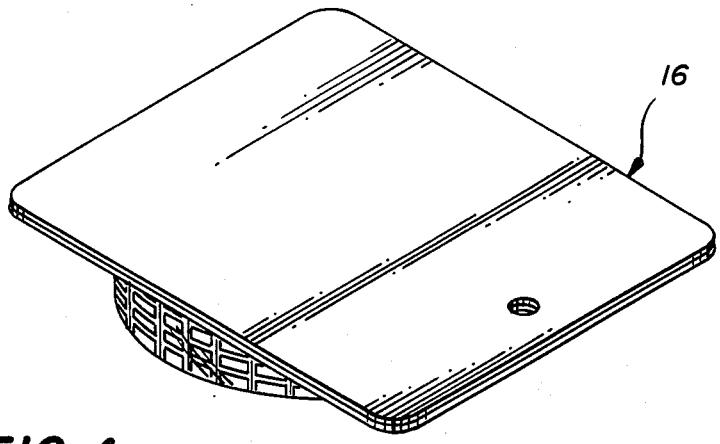
Figure 5:
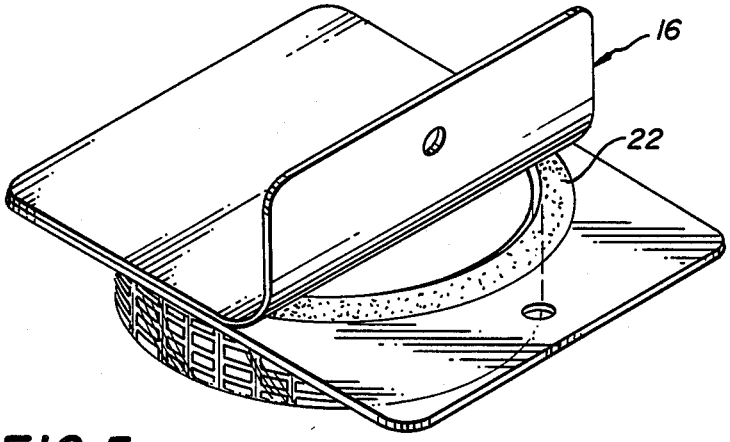
Figure 6:
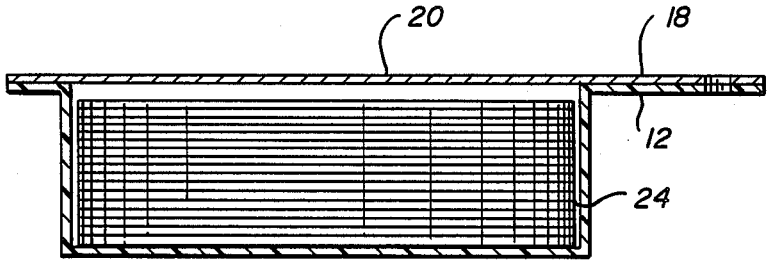

This invention pertains to a continuous method of enclosing a proteinaceous product in a vacuumized and hermetically sealed package having a peelable hermetic reclosure. The package has a body member of a semi-ridged preform plastic with a first planar marginal portion and a central portion shaped to provide a packaging chamber. The package also has a flexible dimensionally stable base having a corresponding second planar marginal portion and a central portion to provide a closure for said packaging chamber. The method requires placing a sufficient quantity of a proteinaceous product in the central portion of the body member to substantially fill the central portion when the package is completed. The first planar marginal portion is positioned face-to-face to the corresponding second planar marginal portion. The assembly is vacuumized and hermetically sealed. The improvement comprising applying an adhesive to either the first planar marginal portion or the corresponding second planar marginal portion to provide at least a portion of the hermetic seal wherein said adhesive is a high molecular weight pressure sensitive hot melt adhesive having a viscosity of between 5,000 to 100,000 centipoise at 300° F. and wherein said adhesive provides a peelable hermetic reclosure. It has been found that when this invention is employed, the adhesive permits the use of a stronger adhesive which can still be opened without excessive force. It further provides through the use of a rigidly formed container adhered to a flexible film a positive reclosure perceived to the customer because the cohesively strong adhesive makes an undisturbed surface for easily rolling the film back into a reclosed position.

DETAILED DESCRIPTION OF THE INVENTION

This invention pertains to a method of enclosing a proteinaceous product. Proteinaceous products are meant to include all meat products, such as beef, pork, poultry, fish and products with meat mixtures and other proteinaceous products, such as cheese. Typically these products are of the sliced luncheon meat variety.

Referring to the figures a body member 10 having a first planar portion 12 and a central portion 14 to provide a packaging chamber is shown. The central portion may be of any suitable cross-sectional shape such as round, square or oval. Suitable materials for making the semi-rigid preform plastic body are Barex, polystyrene, polyester and PVC. Suitably these bodies are thermoformed from sheets 10 to 15 mils thick.

A flexible, dimensionally stable base member 16 is also provided. By dimensionally stable, it is meant a base member having sufficient structural integrity such that when the package is opened, the opening forces do not distort the flexible base member out of its length/-width original shape. The base member has a corresponding second planar marginal proportion 18 and a central portion 20 to provide a closure for the packaging chamber 14. The flexible material may be any such material such as metallized oriented polyesters (Mylars) or gold-coated polyethylene such as Curwood 8032K available from Curwood Inc. of New London, Wis. The high molecular weight pressure sensitive hot melt adhesive is applied to either the first planar margin portion or the corresponding second planar margin portion. The pressure sensitive adhesive melt may be applied totally around the closure as shown by 22 or may be partially applied around the closure and used in conjunction with a low molecular weight pressure sensitive hot melt adhesive or other sealing method to complete the closure.

By high molecular weight pressure sensitive hot melt adhesive it is meant an adhesive having a viscosity of between 5,000 to 100,000 centipoise at 300° F. and preferably between 5,500 to 50,000 centipoise at 300° F. When these adhesives are applied to the body member or base member care must be taken to avoid damaging the packaging materials since these melts are applied at high temperatures. It has been found that when metal-coated_polyethylene or metallized oriented polyester film is employed, the high molecular weight adhesives can be applied directly to the film without distorting them. However, when other materials such as Barex are employed the high molecular weight adhesive cannot be applied directly to the Barex at high temperatures since it deforms the material. A suitable means of applying the adhesive to such a material is to first apply the high molecular weight adhesive to a sheet of silicone rubber in the desired pattern. The adhesive after cooling may then be transferred from the silicone film to the Barax. Suitable adhesives are Fuller 2703 (12,000 centipoise at 300° F.) available from the H. B. Fulle Company of St. Paul Minn. or National 5256-43-12 (5,700 centipoise at 300° F.) available from the National Starch and Chemical Corporation of Ridgewater, N.J. Suitably the adhesives are applied 1 to 10 mils thick and in a pattern ⅛" to 1" wide. In order to prepare the package the body members are filled with a suitable amount of material 24 t substantially fill the central portion of the body member so that when the package is completed the central portion is completely filled. The packages may be filled either singly or may be done in a multiple array such as by filling an array of eight or ten packages. After the proteinaceous product has been filled into the central portion, the base members are aligned with the body members such that the corresponding second planar marginal portion is face-to-face to the first planar marginal portion. A closure machine is employed wherein it is vacuumized suitably to a vacuum of approximately 29.8 inches of mercury and a heated plate is employed to acuate the adhesive and seal the coating film together. The heated plate operation usually is at a 100° to 200° F. After the hermetic seal has been applied the vacuum is released and the chamber opened. If a multiple array of packages have been produced the packages are cut into the desired size.

We claim:

1. A continuous method of enclosing a proteinaceous product in a vacuumized and hermetically sealed package having a peelable hermetic reclosure and having a body member of semi-rigid preformed plastic with a first planar marginal portion and a central portion shaped to provide a packaging chamber, a flexible dimensionally stable base member having a corresponding second planar marginal portion and a central portion to provide a closure for said packaging chamber the method comprising placing a sufficient quantity of proteinaceous product in the central portion of the body member to substantially fill the central portion when the package is completed, positioning the first planar marginal portion face-to-face to the corresponding second planar marginal portion, vacuumizing the assembly, and hermetically sealing the package the improvement comprising applying prior to sealing an adhesive to either the first planar marginal portion or the second planar marginal portion to provide at least a portion of the hermetic seal wherein said adhesive is a high molecular weight pressure sensitive hot melt adhesive having a viscosity of between 5,000 to 100,000 centipoise at 300° F. and said adhesive provides a peelable hermetic reclosure.

2. A method according to claim 1 wherein the high molecular weight pressure sensitive hot melt adhesive is applied to the body member.

3. A method according to claim 1 wherein the high molecular weight pressure sensitive hot melt adhesive is applied to the body member.

4. A method according to claim 1 wherein the high molecular weight pressure sensitive hot melt adhesive forms the complete hermetic seal.

5. A method according to claim 1 wherein the high molecular weight pressure sensitive hot melt adhesive has a viscosity of between 5,500 to 50,000 centipoise at 300° F.

* * * * *